United States Patent [19]

Platz

[11] Patent Number: 4,996,806

[45] Date of Patent: Mar. 5, 1991

[54] LEAD POINT FOR HELICAL EARTH ANCHOR

[75] Inventor: Gerard J. Platz, Armdale, Canada

[73] Assignee: A. B. Chance Company, Centralia, Mo.

[21] Appl. No.: 389,185

[22] Filed: Aug. 3, 1989

[51] Int. Cl.[5] ..... E02D 5/80

[52] U.S. Cl. ..... 52/157

[58] Field of Search ..... 175/388, 394; 405/253; 52/157

[56] References Cited

U.S. PATENT DOCUMENTS

| | | | |
|---|---|---|---|
| Re. 32,076 | 2/1986 | Dziedzic . | |
| 968,471 | 8/1910 | Hardsocg | 175/388 |
| 1,752,524 | 4/1930 | Grant | 175/388 |
| 1,990,341 | 2/1935 | Meyer | 175/388 |
| 2,320,610 | 6/1943 | Kandle | 175/388 |
| 2,320,612 | 6/1943 | Kandle | 175/388 |
| 2,401,250 | 5/1946 | Kandle | 175/388 |
| 2,504,978 | 4/1950 | Henning | 175/388 |
| 2,613,062 | 10/1952 | Harbert | 175/388 |
| 2,817,497 | 12/1957 | Lines | 175/394 |
| 3,508,622 | 4/1970 | Benetti | 175/388 |
| 4,046,207 | 9/1977 | Taylor | 175/394 |
| 4,334,392 | 6/1982 | Dziedzic . | |
| 4,467,575 | 8/1984 | Dziedzic | 52/157 |

*Primary Examiner*—John E. Murtagh

*Attorney, Agent, or Firm*—Hovey, Williams, Timmons & Collins

[57] ABSTRACT

A lead element is provided for use with an earth anchor including an elongated rod and an anchor member having a longitudinal hub provided with first and second axial ends and presenting a bore extending axially therethrough, and an outwardly extending load-bearing element affixed to the hub. The lead element includes a first end portion adapted to extend into the bore of the hub to connect with the elongated rod, and a ground-engaging end portion disposed remote from the first end portion and including an offset tip for penetrating earth contacted by the lead element. A radially extending flange is disposed intermediate the first end portion and the ground-engaging end portion, the flange being adapted to engage the hub of the anchor member and including at least one radially extending protuberance constructed to break earth which comes into contact therewith and to move the broken earth toward the load-bearing element of the hub during installation of the anchor.

6 Claims, 2 Drawing Sheets

LEAD POINT FOR HELICAL EARTH ANCHOR

BACKGROUND OF THE INVENTION

1. Field of the Invention

The present invention relates generally to earth anchors and, more particularly, to a lead point for use with a helical earth anchor which is to be installed in frozen or dense soil.

2. Discussion of the Prior Art

It is known to provide a modular screw anchor having a lead point that is non-integral with the main portion of the anchor which carries a load bearing helical blade. Such a construction is illustrated in U.S. Pat. No. 4,334,392, to Dziedzic, and includes a rod made up of a major elongated portion and an earth-penetrating lead, and a modular one-piece anchor member disposed on and operatively coupled to the rod.

In the known construction, the rod is provided with an outwardly extending, circular shoulder which is adapted to engage a hub portion of the anchor member, and the earth-penetrating lead depends from the circular shoulder in a direction away from the hub portion. As disclosed in the noted patent, the lead is in the form of an elongated, generally square section which is obliquely oriented relative to the longitudinal axis of the major portion of the rod and is beveled at its lower end to present a lowermost earth-cutting edge.

Although the known construction performs in a satisfactory manner under many variable conditions, it has been found that when installation of the anchor is attempted in frozen ground or in grounds made up of dense homogeneous earth, the anchor may be prevented from penetrating the earth beyond a certain point due to the resistance presented to the anchor by the frozen or dense earth. Under such circumstances, the known anchor construction has no utility since it may not be properly installed to a desired depth at which it will provide a predetermined tensile load on the rod.

This condition of an anchor losing its utility in frozen or dense earth is especially prominent in anchors of the type which are provided with hollow hubs adapted to be engaged by a wrench member that extends into the hub during installation of the anchor member. In this type of anchor assembly, a relatively large bearing surface area is presented by the anchor due to the increased cross-sectional area of the hub of the anchor member, and this increased bearing surface area causes an increase in the total resistance exerted on the anchor member by the earth during installation.

Further, although the known screw anchor construction includes an earth-penetrating lead having an obliquely oriented design, it has been found that the screw anchor still is capable of being impeded by frozen and dense earth during installation due to the amount of relatively flat bearing surface of the anchor member which exists on the assembly in the vicinity of the circular shoulder of the rod.

OBJECTS AND SUMMARY OF THE INVENTION

The problems noted above with respect to the known anchor constructions are overcome in large measure by the present invention which provides an earth anchor lead element constructed to improve penetration of the anchor in frozen or relatively dense homogeneous earth.

According to the present invention, an earth anchor member includes a longitudinal hub having first and second axial ends, an outwardly extending, load-bearing element affixed to the hub, and an earth engaging lead element depending from one of the axial ends of the hub. In addition, a radially extending protuberance is disposed between the load-bearing element and the ground engaging lead element, the protuberance including earth breaking and moving means for breaking earth which comes into contact therewith and for moving the broken earth toward the load-bearing element of the hub.

The lead element preferably includes a first end portion adapted to extend into the bore of the hub and having means for permitting connection of the lead element to the elongated rod, and a ground-engaging end portion disposed remote from the first end portion and including means for penetrating earth contacted by the lead element. A radially extending flange is disposed intermediate the first end portion and the ground-engaging end portion, the flange being adapted to engage the hub of the anchor member and including at least one radially extending protuberance. The means for penetrating the earth preferably includes a protruding tip having an apex which is radially offset from the longitudinal axis of the hub by a distance substantially equal to the radius of the flange.

BRIEF DESCRIPTION OF THE DRAWING FIGURES

A preferred embodiment of the invention is described in detail below with reference to the attached drawing figures, wherein.

DETAILED DESCRIPTION OF THE PREFERRED EMBODIMENT

The screw anchor assembly of the present invention, as discussed in detail below, is constructed for use with conventional installation equipment such as that illustrated in FIG. 1. Preferably, the anchor is designed for installation using a conventional digger 10 and anchor wrench 12.

Figure 1:
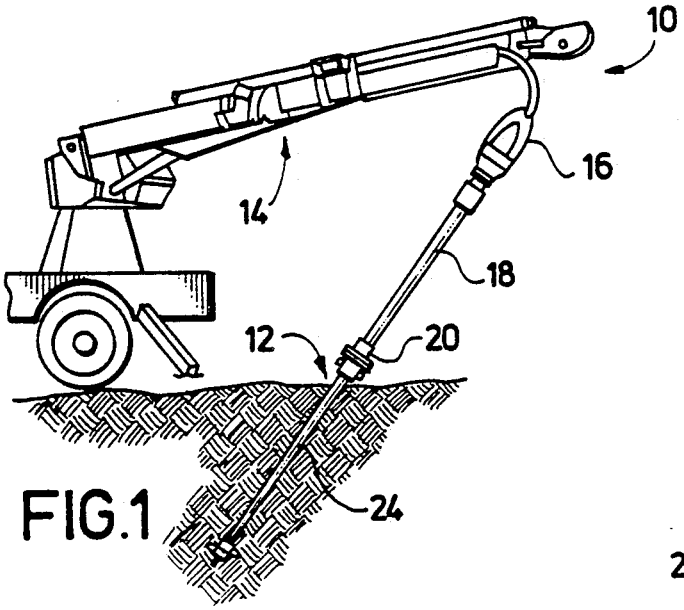
FIG. 1 is a view illustrating the installation of a screw anchor using a powered digger.
Figure 2:
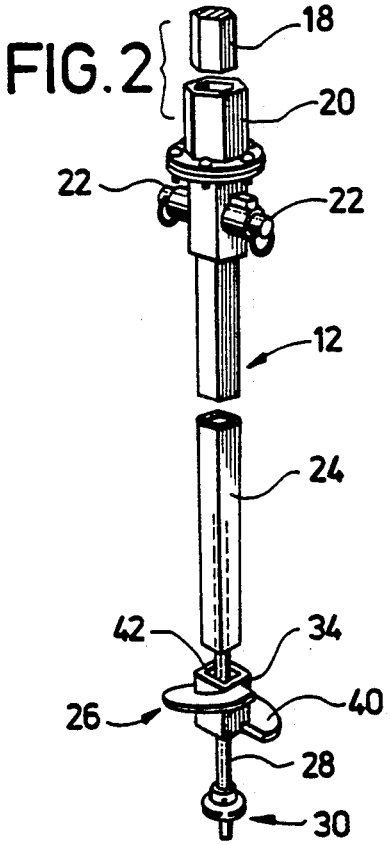
FIG. 2 is a fragmentary, partially exploded view of a screw anchor assembly constructed in accordance with the invention.

The digger 10 illustrated in FIG. 1 includes a boom 14 equipped with a hydraulic motor 16 which is coupled with a drive shaft or kelly bar 18. The kelly bar, in turn, is received within an adaptor 20 attached to an upper end of the wrench 12, as illustrated in FIG. 2, the wrench being of a conventional type such as that described in U.S. Pat. No. 3,377,077. The wrench 12 includes a pair of elongated, shiftable dogs 22 and a tubular, depending, square in cross-section shank portion 24.

Prior to installation of the anchor, a hollow tubular anchor member 26 is first slipped over an elongated rod 28 and a lead element 30 is attached to the lower end of the elongated bar in order to present a flange or shoulder 32 to the anchor member 26 which retains the anchor member on the assembly relative to the rod 28. Thereafter, the shank 24 of the wrench is telescoped over the rod 28 and into a hollow interior region of the anchor member. When this placement of the wrench is made, the lowermost end of the shank 24 is lodged between the surfaces presented by a wrench-engaging portion of the lead element 30 and the surrounding surfaces of the anchor member 26. Thus, a mating fit is established between the shank 24, the lead element 30 and the anchor member 26, and a driving connection is thereby achieved.

Installation of the anchor is accomplished by axial rotation of the shank 24 which is carried out by the motor 16 through the drive described above, which effects corresponding axial rotation of the rod 28, the anchor member 26 and the lead element 30. Once the anchor has been installed to a desired depth, the wrench 12 is withdrawn by pulling the same upward thereby leaving the anchor installed in place.

Figure 3:
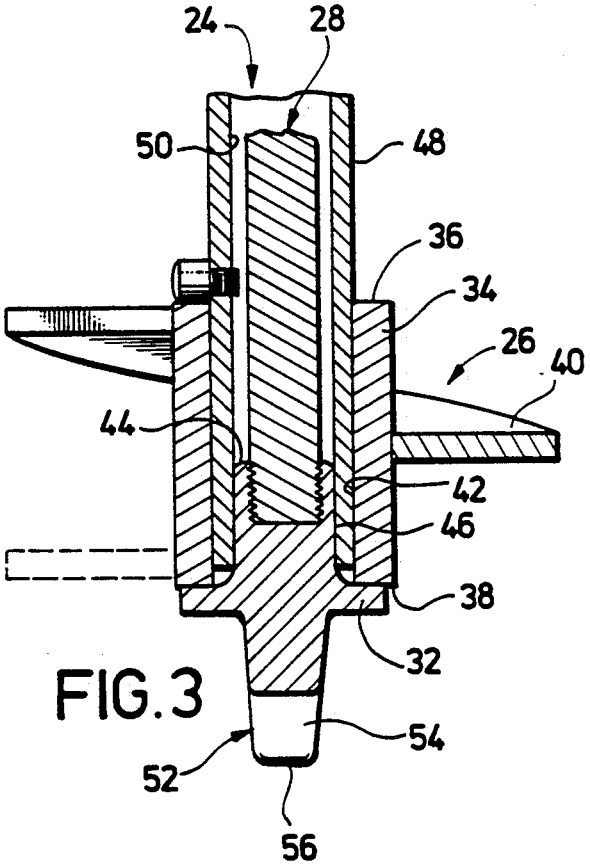
FIG. 3 is a side sectional view of an assembled screw anchor constructed in accordance with the invention.

Turning to FIG. 3, the different elements of the anchor are illustrated. Specifically, the anchor member 26 is formed of a longitudinal hub 34 having first and second axial ends 36, 38 and presenting a bore extending axially therethrough. An outwardly extending, load-bearing element 40 is affixed to an exterior surface of the hub and preferably is formed of a helical blade.

The bore of the hub is defined at least partially by an internal surface 42 of the hub 34 and is shaped to conform to the shape of the outer surface of the shank 24 of the wrench 12. For example, in the illustrated embodiment, both the shank 24 and the internal surface 42 of the hub 34 are generally square in cross-section in order that a driving connection between the wrench 12 and the hub 34 of the anchor member 26 is achieved when the shank portion 24 is inserted in the bore of the hub.

Figure 7:
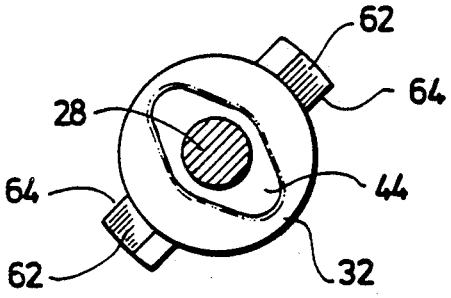
FIG. 7 is a top plan view of the lead element of FIG. 3.

The earth engaging lead element 30 includes a first wrench-engaging end portion 44 which extends into the bore of the hub 34 and is attached to the elongated rod 28 through any conventional means. For example, as illustrated, a threaded connection may be provided between the lead element 30 and the rod 28 which enables the lead element to be attached to the rod after placement of the anchor member 26 over the lower end of the rod. In addition, as shown in FIG. 7, the first end portion 44 includes an outer surface 46 adapted to be received in and mate with the inner surface of the shank 24 such that a driving connection is formed therebetween when the shank is telescopically received on the lead element.

In this manner, during installation of the anchor, as shown in FIG. 3, the shank 24 is disposed between the wrench-engaging end portion 44 of the lead element 30 and the hub 34 of the anchor member 26 with the outer wall surface 48 of the shank being in cooperative, driving engagement with the internal surface 42 of the hub, and with the inner wall surface 50 of the shank being in driving engagement with the wrench-engaging portion of the lead element.

Figure 4:
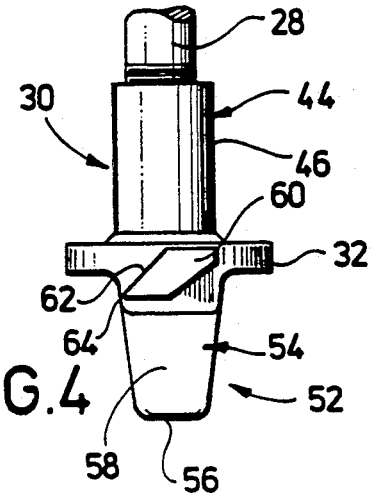
FIG. 4 is a side elevation view of a lead element constructed in accordance with the invention illustrating the manner in which the lead element is attached to an elongated rod of the assembly.
Figure 5:
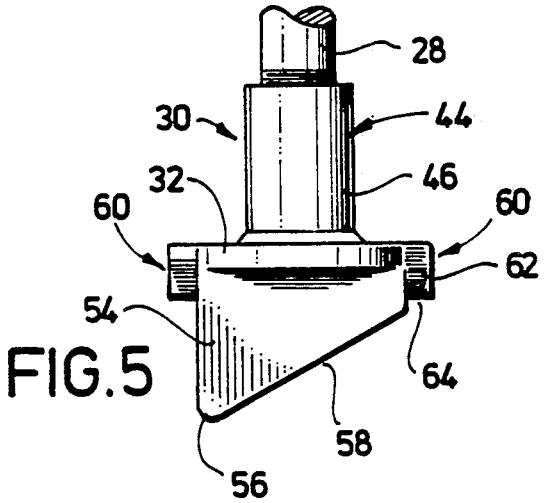
FIG. 5 is a front elevation view of the lead element of FIG. 3.

Turning to FIGS. 4 and 5, a second, depending, ground-engaging end portion 52 of the lead element is also provided which is separated from the first end portion 44 by the radially extending, generally circular flange or shoulder 32 which abuts one of the axial ends 38 of the hub 34 when assembled. This ground-engaging end portion of the lead element 30 includes a protruding triangular tip 54 having an apex 56 which is radially offset from the longitudinal axis of the hub by a distance substantially equal to the radius of the shoulder 32.

Figure 6:
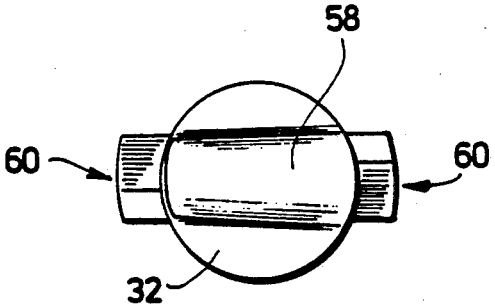
FIG. 6 is a bottom view of the lead element of FIG. 3.

In addition, as shown in FIG. 6, an angled lower surface 58 of the tip extends from the apex 56 across the entire diameter of the circular shoulder 32 so that during installation of the anchor, the total area of earth exposed to the region of the lead element defined by the flange or shoulder 32, is contacted by the triangular tip 54 of the lead element. By this contact of the angled tip with the earth immediately beneath the lead element, earth is broken and pushed radially outward of the lead element during rotation of the anchor such that no bearing contact is made between unbroken earth and flat areas of the lead element.

Returning to FIG. 5, the flange or shoulder 32 is provided with a pair of diametrically opposed, radially extending protuberances 60, each of which includes earth breaking means for breaking earth which comes into contact therewith and earth moving means for moving the broken earth toward the load-bearing, helical element 40 of the hub 34. As shown in FIG. 6, the earth breaking and moving means of each protuberance 60 preferably includes an angled planar surface 62 which terminates at a radially extending edge 64. The edge 64 is disposed in a reference plane which is perpendicular to the longitudinal axis of the hub 34 and which is displaced from the flange or shoulder 32 in the direction of the tip 54 such that, during installation of the anchor, the edges 64 and surfaces 62 of the protuberances 60 come into contact with earth immediately after contact is made by the tip 54 and prior to contact being made by the flange or shoulder 32. This relationship between the longitudinal position of the protuberance edges 64 and the longitudinal position of the shoulder or flange is illustrated in FIG. 5.

By constructing the lead element 30 in this manner, the tip 54 of the element and the protuberances 60 operate, during rotation of the anchor, to break up earth coming into contact with the anchor and to move the earth radially and axially to a position rearward of the lead element 30 in the direction of downward travel of the anchor.

With regard to the angle at which the surfaces 62 of the protuberances 60 are disposed, it is noted that any angle which assists in the break-ing-up and moving of earth is suitable, and that the angle could be anywhere between 0 and 90 degrees relative to the reference plane. Preferably, an angle of about 45 degrees is employed to maximize the earth breaking and moving effect of the protuberances on the earth during installation of the anchor. In addition, the remaining surfaces of the protuberances may be constructed to provide any desired effect during rotation of the lead element.

Although the invention has been described with reference to the preferred embodiment shown in the drawing figures, it is noted that substitutions may be made and equivalents employed herein without departing from the scope of the invention as set forth in the claims.

What is claimed is:

1. An earth anchor apparatus for use with an earth anchor including an elongated rod which is telescopically received within an elongated tubular wrench member adapted to operatively engage the anchor member, the apparatus comprising:

a longitudinal hub having a central longitudinal axis and first and second axial ends, rotation of the hub about the longitudinal axis defining a first circular area of predetermined diameter;

an outwardly extending, load-bearing element affixed to the hub and extending radially outward of the hub beyond the first circular area defined by rotation of the hub, rotation of the load-bearing element about the longitudinal axis defining a second circular area concentric with and greater than the first circular area; and an earth engaging lead element depending from one of the axial ends of the hub, the lead element including a flange sized to retain the hub on the elongated rod, rotation of the load-bearing element about the longitudinal axis defining a second circular area concentric with and greater than the first circular area, the earth engaging lead element further including a protruding tip having earth breaking means for breaking earth which comes into contact with the earth engaging lead element within the third circular area during rotation of the lead element, and a protuberance extending radially outward of the flange and including earth breaking and moving means for breaking earth which comes into contact therewith and for moving the broken earth toward the load-bearing element of the hub, the protuberance extending radially outward of the annular flange by a predetermined distance sufficient to permit the breaking and moving means to break earth which comes into contact with the lead element outside the third circular area and within the first circular area during rotation of the lead element, the protruding tip and the protuberance together breaking earth during rotation of the apparatus about the longitudinal axis of the hub within the first circular area such that earth located outside the first circular area and within the second circular area is left substantially undisturbed by the lead element.

2. The earth anchor apparatus as recited in claim 1, wherein the radially extending protuberance includes a ground-breaking edge that extends in a reference plane which is substantially perpendicular to the longitudinal axis of the hub, and a ground-moving surface that is coplanar with the ground-breaking edge and angled relative to the reference plane.

3. In combination:

an elongated rod;

an anchor member including a longitudinal hub having a central longitudinal axis and first and second axial ends and presenting a bore extending axially therethrough, and an outwardly extending, load-bearing element affixed to the hub, the hub being provided with an internal surface which defines at least a portion of the bore, rotation of the hub about the longitudinal axis defining a first circular area of predetermined diameter, the load-bearing element extending radially outward of the hub beyond the first circular area and defining a second circular area concentric with and larger than the first circular area during rotation of the anchor member about the longitudinal axis;

an earth engaging lead element including a first wrench-engaging end portion extending into the bore of the hub and being attached to the elongated rod and a second depending end portion separated from the first end by a radially extending flange which is in engagement with one of the axial ends of the hub the flange defining a third circular area concentric with and smaller than the first circular area during rotation of the lead element about the longitudinal axis; and a wrench including an elongated tubular shank having inner and outer wall surfaces, the wrench being received over the rod in a telescoping manner and including a portion which extends into the hub bore such that the portion is disposed between the wrench-engaging end portion of the lead element and the hub with the outer wall surface of the wrench in cooperative, driving engagement with the internal surface of the hub, and with the inner wall surface of the wrench in driving engagement with the wrench-engaging portion of the lead element, the earth engaging lead element including at least one protuberance extending radially outward from the flange and including earth breaking and moving means for breaking earth which comes into contact therewith and for moving the broken earth toward the load-bearing element of the hub, the protuberance extending radially outward of the annular flange by a predetermined distance sufficient to permit the breaking and moving means to break earth which comes into contact with the lead element outside the third circular area and within the first circular area during rotation of the lead element, the second depending end portion and the protuberance together breaking earth during rotation of the lead element about the longitudinal axis of the hub within the first circular area such that earth located outside the first circular area and within reach of the load-bearing element is left substantially undisturbed by the lead element.

4. The combination as recited in claim 3, wherein the radially extending protuberance includes a ground-breaking edge that extends in a reference plane which is substantially perpendicular to the longitudinal axis of the hub, and a ground-moving surface that is coplanar with the ground breaking edge and angled relative to the reference plane.

5. The combination as recited in claim 3, wherein the depending end portion of the earth engaging lead element includes a protruding tip having an apex which is radially offset from the longitudinal axis of the hub.

6. The combination as recited in claim 3, wherein the wrench-engaging end portion of the lead element includes an axially extending, threaded bore adapted to receive the elongated rod.

* * * * *